US006686679B1

(12) United States Patent
Tuck et al.

(10) Patent No.: US 6,686,679 B1
(45) Date of Patent: Feb. 3, 2004

(54) FIELD ELECTRON EMISSION MATERIALS AND DEVICES

(75) Inventors: Richard Allan Tuck, Slough (GB); Hugh Edward Bishop, Abingdon (GB)

(73) Assignee: Printable Field Emitter Limited, Chilton (GB)

( * ) Notice: Subject to any disclaimer, the term of this patent is extended or adjusted under 35 U.S.C. 154(b) by 0 days.

(21) Appl. No.: 09/762,066

(22) PCT Filed: Jul. 30, 1999

(86) PCT No.: PCT/GB99/02277

§ 371 (c)(1),
(2), (4) Date: Jan. 30, 2001

(87) PCT Pub. No.: WO00/08667

PCT Pub. Date: Feb. 17, 2000

(30) Foreign Application Priority Data

Jul. 31, 1998 (GB) ..... 9816684

(51) Int. Cl.[7] ..... H01J 1/30
(52) U.S. Cl. ..... 313/309; 445/3
(58) Field of Search ..... 313/309, 326, 313/351; 445/3, 50, 60; 204/192.1, 192.11, 192.32, 192.34, 298.01, 298.02, 298.04, 298.31, 298.36

(56) References Cited

U.S. PATENT DOCUMENTS

| | | | | |
|---|---|---|---|---|
| 5,266,867 A | | 11/1993 | Sakurai | |
| 5,312,514 A | * | 5/1994 | Kumar | 216/11 |
| 5,628,659 A | * | 5/1997 | Xie et al. | 445/3 |
| 5,656,883 A | | 8/1997 | Christensen | |
| 6,097,139 A | * | 8/2000 | Tuck et al. | 313/310 |

FOREIGN PATENT DOCUMENTS

| | | |
|---|---|---|
| EP | 0262676 B1 | 3/1996 |
| GB | 2322000 A | 8/1998 |

* cited by examiner

*Primary Examiner*—Eric S. McCall
(74) *Attorney, Agent, or Firm*—Barnes & Thornburg

(57) ABSTRACT

A field electron emission material has a substrate with an electrically conductive surface. Electron emission sites on the conductive surface each include a layer of electrically insulating material to define a primary interface region between the conductive surface and the insulating layer, and a secondary interface region between the insulating layer and the vacuum environment,. Each primary interface region is treated or created so as to enhance the probability of electron injection form the conductive surface into the insulating layer. Each primary interface region after such treatment or creation is either an insulator or graded from conducting adjacent the conductive surface to insulating adjacent the insulating layer.

25 Claims, 5 Drawing Sheets

FIELD ELECTRON EMISSION MATERIALS AND DEVICES

This invention relates to field electron emission materials, and devices using such materials.

There have been many proposals for broad-area field electron mission materials, many or most of which concentrate on the use of diamond or amorphous carbon as an emitting material of special significance. In the context of this definition, a broad-area field emitter is any material that by virtue of its composition, micro-structure, work function or other property emits useable electronic currents at macroscopic electrical fields that might be reasonably generated at a planar or near-planar surface.

The reader is referred to UK Patent 2 304 989 (Tuck, Taylor & Latham) for examples of emitting materials, including many other than diamond. The present application relates particularly to field electron emission materials involving a primary interface region between a conductive surface, or an electrically conductive particle on it, and an insulating layer, and a secondary interface region between that insulating layer and the environment in which the field electron emission material is disposed.

A critical issue in insulator-based field emitting systems is the injection of electrons from a substrate (often a metal) into the conduction band of the insulator.

Figure 1A:
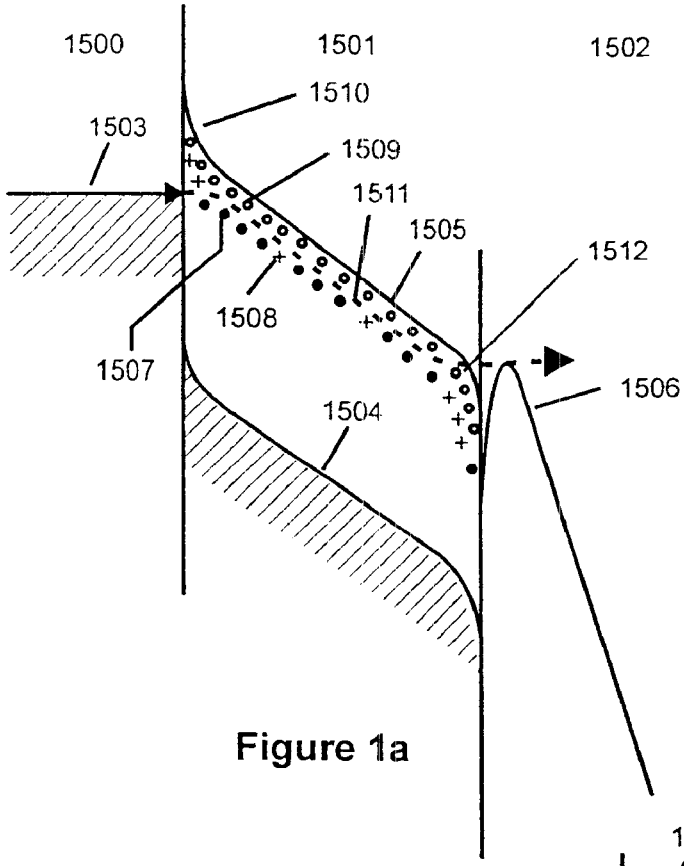

FIG. 1*a* is a reasonable representation of the current state of knowledge of such systems, although this still falls short of an exact description. In particular the sharp cut off in the density of states at the band edges is unlikely in highly heterogeneous amorphous materials. However, with these caveats in mind, such a diagram is a useful representation. Electron emission through a dielectric coating is effectively controlled by three factors: injection of the electrons 1503 into the dielectric from the conducting substrate 1500; transport through the dielectric to the surface as indicated by line 1511; and subsequent escape through or over the surface barrier 1506 into the vacuum 1502. A practical insulating layer will have both donor 1507 and acceptor defect sites 1509 in the band gap. The most notable effect is when there are donor states in the band gap relatively close to the bottom of the conduction band. In this case electrons from the donor states 1507 tunnel back into the metal and a Schottky barrier 1510 is formed, see also FIG. 1(*b*), which enables electrons to tunnel through it from the metal into the conduction band. Bayliss and Latham (K. H. Bayliss and R. V. *Latham, Proc. Roy. Soc. Lond. A* 403 (1986) 285–311) have described the conditions required for forming such a Schottky barrier and its significance to electron emission into the dielectric. The Schottky barrier has an associated forward voltage drop. This becomes a particular issue as the particle size is reduced in the metal-insulator-metal-insulator-vacuum (MIMIV) emitters described by Tuck, Taylor and Latham (UK Patent 2304989) to enable them to be used in gated structures such as those described in our patent application GB 2 330 687. Whilst the electric field across the MIM region of a MIMIV emitter can be maintained by reducing the insulator thickness, the absolute voltage will fall to values below the forward voltage drop of the Schottky barrier thus stopping injection of electrons into the insulator.

A more general discussion of the metal-insulator contact in the case of diamond and diamond-like carbon is given by Robertson (J. Robertson, *Mat. Res. Soc. Symp. Proc.* 471 (1997) 217–229).

Transport through the dielectric depends critically on its nature. For relatively defect-free material, transport will be in the conduction band, with lattice scattering limiting conduction. Electrons may become ballistic rather than staying close to the bottom of the conduction band (D. J. DiMaria and M. V. Fischetti, *Excess electrons in dielectric media, eds Ferradini and Jay-Gerin*, p315–348, (CRC Princetoun:1991) ISBN 0849369622). By contrast, in a glassy material, with many donor and trapping sites, conduction will be dominated by the Poole-Frenkel effect, field-assisted ionisation of donors and traps, and the electrons will remain close to the Fermi level. In general conduction is non-ohmic with evidence of saturation effects, presumably due to space charge in some cases.

The final step is the emission of electrons from the dielectric surface into vacuum. In the case of hydrogen terminated diamond which has a negative electron affinity, and with the electron transport in the conduction band, there is no barrier to overcome and all electrons arriving at the surface will be emitted. In the case of a low positive electron affinity, such as an un-terminated diamond surface, there is usually sufficient electron heating in the transport to the surface to allow emission through thermionic and thermally enhanced tunnelling. For higher electron affinities, either the field at the surface must be high enough to enable tunnelling or there must be sufficient ballistic electrons that can pass over the barrier. Otherwise the surface must be modified to lower the effective electron affinity. Two possible means of achieving this lowering of the surface barrier are either modifying the surface composition e.g. by caesiating the surface or emptying surface donor states to leave a positively charged surface. The latter is the basis of the forming mechanism proposed by Bayliss and Latham.

An emitter of this type has initially to undergo a forming process. A relatively high switch-on field has to be applied to the device to obtain emission, but after removing this field, a much lower threshold field is required for emission. The actual mechanisms responsible for this behaviour are very difficult to establish because of the small dimensions of the conducting channels. Dearnaley et al. (G. Dearnaley, A. M. Stoneham and D. V. Morgan, *Rep. Prog. Phys.*, 33, (1970) 1129–1191) suggest the formation of conducting filaments in the films for MIM (metal-insulator-metal) structures, while Bayliss and Latham suggest that a positive space charge is established in the insulator and at its surface.

Many papers on diamond and diamond-like-carbon field emitters make no mention of any forming process. However, a forming process is described for diamond emitters both by Xu et al. (N. S. Xu, Y. Tzeng, and R. V. Latham, *J. Phys. D* 26 (1993) 1776–1780) and by Givargizov et al. (E. I. Givargizov, V. V. Zhirnov, A. V. Kuznetsov and P. S. Plekhanov, *J. Vac. Sci. Technol, B* 14 (1996) 2030–31). It seems probable that other workers in this area concentrate on the reversible I-V characteristics of the emitters and may overlook the initial forming process.

It is probable that no one mechanism is appropriate to all situations and that a combination may apply in many cases.

For diamond films, the limiting factor to emission has been found by many workers to be the metal-diamond back contact (e.g. M. W. Geis, J. C. Twichell and T. M. Lyszczarz, *J. Vac. Sci. Technol. B* 14, (1996) 2060–67) and U.S. Pat. No. 5,713,775. However, no systematic method of overcoming this problem has been described.

Examples of ad hoc solutions are as follows.

Geis et al. showed that emission thresholds could be greatly reduced by introducing nitrogen into the diamond. The nitrogen defects are close enough to the conduction band to allow a Schottky barrier to be formed, reducing the field necessary to inject electrons into the diamond conduction band. Geis et al. considered also that "roughening" of the surfaces between metal and diamond was of considerable importance, roughening being of the order of 10 nm.

In fact it is likely that many examples of diamond and carbon-based films have an interface roughness of this order without intentional treatments. What is really needed is a more general strategy that can be applied to interfaces whether they are rough or smooth.

Schlesser et al reported improved emission for an annealed molybdenum-diamond interface (R. Schlesser, M. T. McClure, W. B. Choi, J. J. Hren and Z. Sitar, *Appl. Phys Lett.* 70 (1997) 1596–98)

Chuang et al reported improved emission for diamond deposited onto an annealed gold layer on silicon (F. Y. Chuang, C. Y. Sun, H. F. Cheng and I. N. Lin, *Appl. Phys. Lett.* 70 (1997) 2111–3).

In the last two cases it is probable that the Schottky barrier has been reduced or eliminated through the formation of some form of an ohmic contact. It is however difficult to be certain of the operating mechanisms of the recipes described in these publications as insufficient information is given about the nature of the diamond films.

Two more brief and general disclosures of emission from diamond films are C. Kimura, K. Kuriyama, S. Koizumi, M. Kamo and T. Sagino, Paper L-2, and T. Yamada, A. Sawabe, K. Okano, S. Koizumi and J. Itoh, Paper P-45, both papers being from IVESC '98—The International Vacuum Electron Sources Conference held in Tskuba City, Japan. The first of these papers discusses the use of titanium and gold with phosphorus-doped diamond films, and notes the effect of different resistivities of the diamond film. The second of these papers discusses the use of both titanium and gold with nitrogen-doped and boron-doped diamond emitters. Both papers emphasise the perceived importance of diamond as a choice of emitter material to achieve good emission characteristics, but disclose no general teaching as to how to achieve good emission characteristics from materials generally.

Preferred embodiments of this invention aim to provide a systematic method for producing optimised low manufacturing cost field emitter materials based upon insulating coatings that have both a low emission threshold field and a controlled saturation above a chosen current density.

According to one aspect of the present invention, there is provided a method of creating a field electron emission material, comprising the steps of:

providing a substrate having an electrically conductive surface;

providing a plurality of electron emission sites on said conductive surface, each of said sites including a respective layer of electrically insulating material to define a primary interface region between said conductive surface, or an electrically conductive particle on it, and said insulating layer, and a secondary interface region between said insulating layer and the environment in which the field electron emission material is disposed; and treating or creating the primary interface region of each said layer so as to enhance the probability of electron injection from said conductive surface into said layer, such treatment or creation comprising:

depositing a layer of material between said conductive surface and insulating layer, which layer of material has properties intermediate those of said conductive surface and said insulating layer; or doping said conductive surface and/or insulating layer with a material that segregates out at said primary interface region during subsequent processing; or reaction of the materials of said conductive surface and insulating layer; or creating said primary interface region as a region of high electrically active doping, high defect density or intermediate chemical composition:

such that said primary interface region after said treatment or creation is either an insulator or graded from conducting adjacent said conductive surface to insulating adjacent said insulating layer.

Said layer of material between said conductive surface and insulating layer may be created by a gradual change in stoichiometry, composition or doping of the material of the layer, to reduce discontinuity.

A method as above may further comprise the step of selecting the properties of said insulating layer of each said site between its respective primary and secondary interface regions to limit the emission current flowing through said layer to a predetermined value.

Preferably, said primary interface region is a layer of material of low work function.

Preferably, said primary interface region is created as a region of high doping, defect density or intermediate composition.

Such a region of high defect density may be created by heat treating a major portion of a highly defective insulator material to create said insulating layer, whilst avoiding heat treatment of an end portion of said highly defective insulator material, which end portion then remains as said region of high defect density.

Preferably, said secondary interface region is provided by modifying the surface of said insulating layer, to enhance the probability of electron transmission from said insulating layer to said environment.

Modification of said surface may be by a local increase in defect density of the material of the insulating layer.

Modification of said surface may be by a gradual change in stoichiometry, composition or doping to reduce discontinuity.

Modification of said surface may be by local heat treatment of said insulating layer.

Said electron emission sites may be defined by tips or projections created on said conductive surface.

Said electron emission sites may be defined by electrically conductive particles coated on said conductive surface.

Said secondary interface region may be defined at a region of said insulating layer between a respective said particle and said conductive surface.

Said secondary interface region may be defined at a region of said insulating layer which is provided on a portion of a respective said particle which faces away from said conductive surface.

Each said particle may have a first layer of electrically insulating material between said substrate and particle and a second layer of electrically insulating material between said particle and environment, the arrangement being such that, in use, electron emission takes place by injection of electrons through one said primary interface region defined between said substrate and said first insulating layer, by injection of electrons through another said primary interface region defined between said particle and said second insulating layer, and by transmission of electrons through said secondary interface region defined between said second insulating layer and said environment.

Preferably, said first and second insulating layers are provided by respective portions of a common electrically insulating material.

Said insulating layer may be of a material other than diamond.

Preferably, the distribution of said sites over the field electron emission material is random.

Said sites may be distributed over the field electron emission material at an average density of at least $10^2$ $cm^{-2}$.

Said sites may be distributed over the field electron emission material at an average density of at least $10^3$ $cm^{-2}$, $10^4$ $cm^{-2}$ or $10^5$ $cm^{-2}$.

Preferably, the distribution of said sites over the field electron emission material is substantially uniform.

The distribution of said sites over the field electron emission material may have a uniformity such that the density of said sites in any circular area of 1 mm diameter does not vary by more than 20% from the average density of distribution of sites for all of the field electron emission material.

Preferably, the distribution of said sites over the field electron mission material when using a circular measurement area of 1 mm in diameter is substantially Binomial or Poisson.

The distribution of said sites over the field electron emission material may have a uniformity such that there is at least a 50% probability of at least one emitting site being located in any circular area of 4 $\mu$m diameter.

The distribution of said sites over the field electron emission material may have a uniformity such that there is at least a 50% probability of at least one emitting site being located in any circular area of 10 $\mu$m diameter.

The invention extends to a field electron emission material produced by any of the above methods.

According to a further aspect of the present invention, there is provided a field electron emission device comprising a field electron emission material as above, and means for subjecting said material to an electric field in order to cause said material to emit electrons.

It will be appreciated that the electrical terms "conducting" and "insulating" can be relative, depending upon the basis of their measurement. Semiconductors have useful conducting properties and, indeed, may be used in the present invention as said conductive surface or particles. In the context of this specification, the or each said conductive surface or particle has an electrical conductivity at least $10^2$ times (and preferably at least $10^3$ or $10^4$ times) that of said electrically insulating material.

Figure 1B:
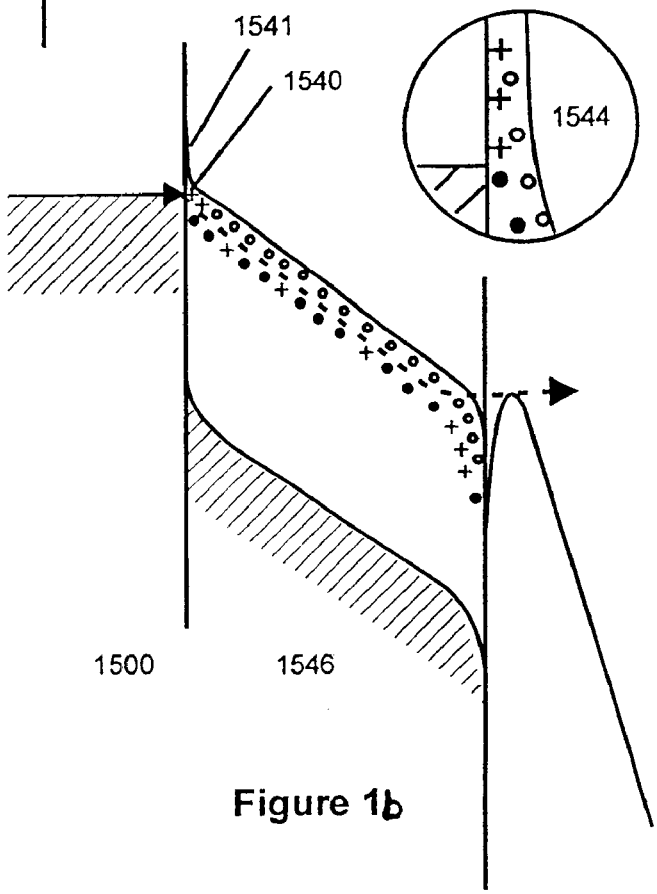

For a better understanding of the invention, and to show how embodiments of the same may be carried into effect, reference will now be made, by way of example, to the accompanying diagrammatic drawings, in which:

FIG. 1*a* shows the band structure for an insulator in contact with a metal under conditions of high electric field;

FIG. 1*b* shows the band structure for an insulator in contact with a metal with a matching layer of high doping level or intermediate composition under conditions of high electric field;

FIGS. 2*a* to 2*i* show various optimised insulating coatings for field emission;

FIGS. 3*a* to 3*d* show applications of optimised contacts between metals and insulators in field emitter materials and devices; and FIGS. 4*a* to 4*d* show applications of optimised insulator surface layers in field emitter materials and devices.

Preferred embodiments of the invention aim to improve the performance of emitters based upon low cost materials and deposition systems, although the teachings of this work are equally applicable to diamond and carbon based emitters.

The first essential is to have as low a barrier as practicable for the injection of electrons into the dielectric. This requirement implies either minimising the width of the Schottky barrier or forming a truly ohmic contact.

The createation and control of metal-semiconductor interfaces is well established in that art, see for instance E. H. Rhoderick and R. H. Williams, *Metal-semiconductor contacts, Clarendon Press, Oxford*, 1988. It is known that for semiconductors a low Schottky barrier or an ohmic contact may in principle be obtained by a careful selection of the contact materials. However, the vast majority of contacts in semiconductors depend on heavily doping the semiconductor in the interface region to make the depletion layer at the interface very thin. Bayliss and Latham show that a population of impurity and donor levels at a concentration of about $10^9$ $cm^{-3}$ near the bottom of the conduction band is necessary to form the type of Schottky barrier required to explain pre-breakdown emission from MIV sites on cathode surfaces. Increasing the defect population above $10^{19}$ $cm^{-3}$ will allow a further narrowing of the depletion layer.

To be a useful emitter in field emission devices, the bulk of the dielectric must be sufficiently insulating at the device operating temperature to maintain any space charge created in the forming process but pass the full operating current for the device at an external field of ~10 MV $m^{-1}$ V/micron). The conductivity and any tendency to space charge limitation may be controlled both by limiting the donor and trap densities and by the thickness of the coating. The optimum densities will be lower than those required at the metal-insulator interface to reduce the thickness of the Schottky barrier. In a practically realisable system the donor and trap densities will most easily be a property of the bulk insulator composition and deposition method, and consequently, for optimum performance, modification of the interface between the insulator and metal is required.

Alternatively, the outer regions of a highly defective insulator may be locally heat-treated, as by annealing, for example, with a laser, to create the desired structures.

To enable the reader to better understand the preferred embodiments of the inventions described herein, the electronic situation in a MIV structure without modification of the metal-insulator contact will be described with reference to FIG. 1*a*. The figure depicts a metallic substrate 1500, an insulator layer 1501 and a vacuum region 1502. The upper edge of the valence band 1504 and conduction band edge 1505 are shown. In the steady state following forming (see Bayliss and Latham) electrons 1503 tunnel into the insulator and are transported in the penetrating field by Poole-Frenkel hopping between the donor 1507 and acceptor 1509 states. Vacancies 1508 in the donor levels create a space charge which maintains the conducting channel once the external field has been removed. Electrons are heated in the penetrating field and may tunnel through or be emitted over the field-modified surface potential barrier 1506.

Again with reference to FIG. 1*a*, control of the donor and trap densities in the near surface region 1512 is beneficial to emission. By the near surface region we mean the area ~10 nm below the surface. Since the forming mechanism is initiated by tunnelling of electrons from the surface and near surface donors, a modest increase in the concentration of these donors will allow the switch-on field to be reduced.

In another preferred embodiment of the present invention there is provided, with reference to FIG. 1*b* (wherein the symbols for donors, acceptors and ionized donors are the same as in FIG. 1*a*) an insulating layer 1546 the composition of which (with respect to density of charge carriers, mobility, trap density et cetera) is chosen such that if required, once electroforming has taken place, current limitation occurs at the desired value. There is then created a layer of high doping, defect density or intermediate composition 1540 disposed between the substrate and insulator layer. Said layer reduces the thickness of the depletion region 1541 of the Schottky barrier thus facilitating the tunnelling of electrons into the insulator 1546. A magnified view of the depletion region is show as 1544 with the symbols having the same meaning as those in Figure la. Said layer may either be:

- deposited on the metal substrate prior to coating with the insulator;
- created in situ by doping the substrate or insulator with material that segregates out at the interface during subsequent processing;
- or created by choosing a substrate and an insulator such that they react together to create said layer.

In another preferred embodiment of the present invention there is provided an emitter layer wherein the surface of the insulator presented to the medium into which the electrons are emitted (often a vacuum) is modified to facilitate electron emission. Said modifications may include:

- a local increase in defect density relative to the bulk of the insulating layer;
- a gradual change in stoichiometry, composition or doping relative to the bulk of the insulating layer, thus avoiding a discontinuity.

Embodiments of this invention may have many applications and some will be described by way of the following examples. It should be understood that the following descriptions are only illustrative of certain embodiments of the invention. Various alternatives and modifications can devised by those skilled in the art.

Field emission from a clean metal surface takes place at electric fields ~1000 MV $m^{-1}$ Consequently, an arrangement with a beta factor greater than unity is required. This is usually a fabricated atomically sharp point. By beta factor we mean the enhancement of the macroscopic field by the pointed structure. Coating the surface with an insulator layer, especially an optimised one as described herein, and then forming a conducting channel reduces the required field by approximately one order of magnitude. Given that safe electrical fields within vacuum electronic devices are approximately 10 M V $m^{-1}$, structures with beta factors of ~10 are required for a technologically useful field emission material. Beta factors of this magnitude can be realised by relatively blunt microfabricated tips with radii of curvature of 20 nm to 100 nm or rough surfaced particles.

FIGS. 2*a* to 2*j* show conducting surfaces 1600 with beta factors of ~10 coated with various layers.

EXAMPLE 1

Figure 2A:
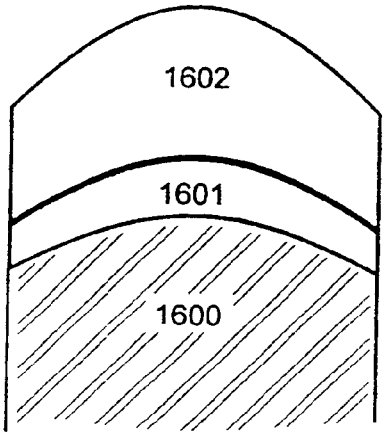
Figure 2B:
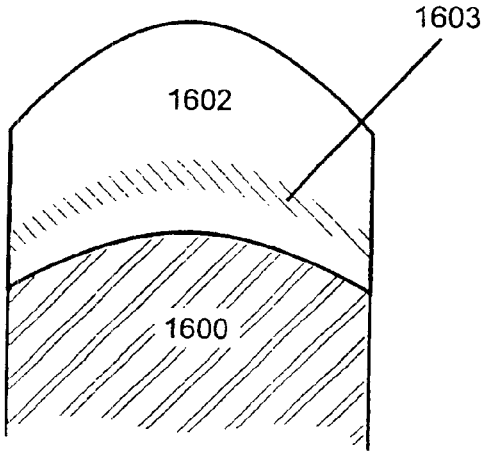

Moving now to FIG. 2*a*, a conducting layer 1601 comprises a gold-titanium alloy, the titanium concentration being a few atomic percent. Such a layer may be deposited by sputter coating from a target with the required alloy composition. An insulator layer 1602 is composed of silica which may be, by way of example, deposited by sputter coating, plasma deposition or by heating a layer of polysiloxane spin-on glass to ~500° C. Upon heating, the titanium will segregate out of the gold-titanium layer and concentrate at the interface with the silica. Titanium will reduce silica to silicon. As a result a region 1603 shown in FIG. 2*b* will be created, having properties intermediate those of the conducting and insulating layers. Thus, this will be graded from gold/titanium through titanium, silicon, the sub-oxides of silicon to silica. Said graded layer will reduce the width of the Schottky barrier and facilitate the injection of electrons into the insulator. Similar results may be obtained with gold-hafnium, gold-zirconium alloys and alloys containing glass forming elements such as boron, silicon, vanadium, phosphorous, selenium, tellurium, arsenic and antimony.

EXAMPLE 2

Figure 2C:
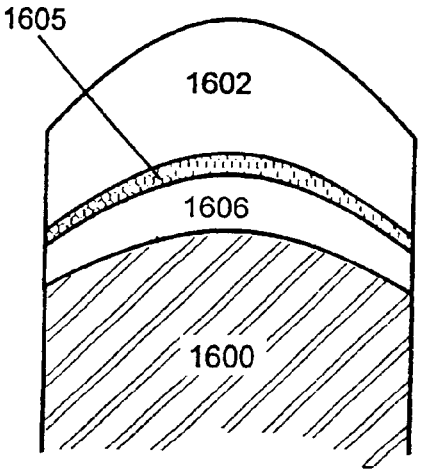
Figure 2D:
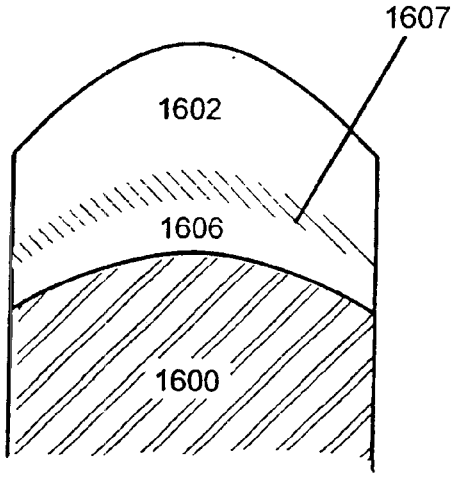

Moving now to FIG. 2*c*, a layer of chemically reactive (often reducing) material 1605 is deposited on an optional additional conducting layer 1606 by means of spin coating, electrophoresis or other method. The layer 1605 reacts with either or both of the insulating layer 1602 and the conducting layer 1606 (or substrate 1600) to produce the intermediate layer 1607 shown in FIG. 2*d*. A suitable material for layer 1605 is colloidal graphite which, because of its high surface energy, can, following heat treatment, reduce silica, a likely material for the insulator, to silicon sub-oxides. This produces a layer of intermediate properties that facilitates the tunnelling of electrons from the substrate into the insulator.

EXAMPLE 4

Figure 2E:
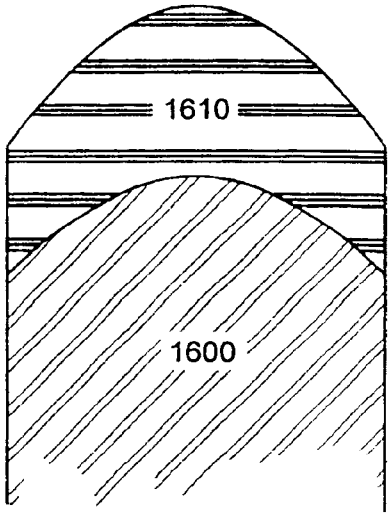
Figure 2F:
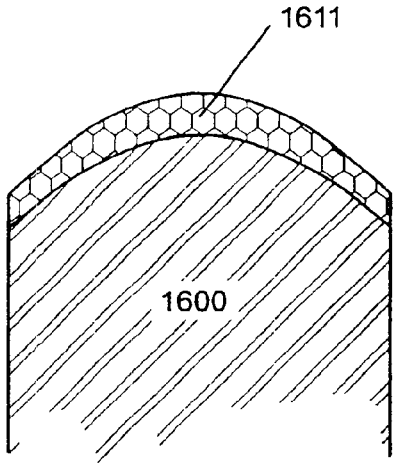

Moving now to FIG. 2*e*, the substrate 1600 is coated with a layer of resinate gold ink 1610 by, for example, spraying, screen printing, brushing or spin coating. Such resinate golds are well known in the decorative glass and pottery industries and to a lesser extent for electronic applications e.g. Koroda U.S. Pat. No. 4,098,939. Some aspects of their chemistry are described by A A Milgran (Migram, A. A. *journal Electrochemical Society, Solid State Science*. February. 1971, pp287–293). Milgram states that the two principle ingredients in addition to the gold chemicals are rhodium, which controls grain growth to produce a continuous film, and chromium which aids adhesion to the substrate.

On firing said resinate gold ink layer in air, a continuous gold film (FIG. 2*f*) 1611 ~100 nm thick doped with rhodium and chromium is produced.

Figure 2G:
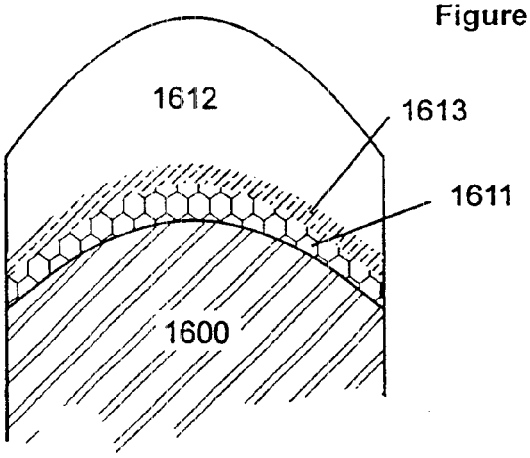

Moving to FIG. 2*g*, a layer of insulator 1612 such as silica or glass is now deposited by physical or chemical means—a number of such methods having been described previously. Heating of the completed layered structure causes a reaction at the interface between the additives in the gold layer 1611 and the insulator 1612 to produce a graded structure 1613 comprising, it is believed, a network of silicates and chromates. This produces a layer of intermediate properties that facilitates the tunnelling of electrons from the substrate into the insulator.

EXAMPLE 4

Figure 2H:
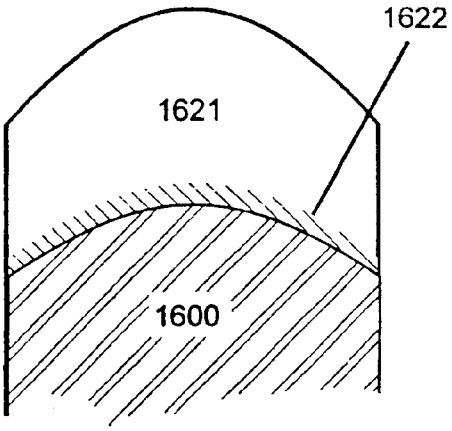

Moving now to FIG. 2*h*, the substrate 1600 is coated with a $SiO_x$ layer in a plasma enhanced CVD (PECVD) reactor using a silane and oxygen mix. Initially the gas mixture is adjusted to deposit a layer 1622 which is stoichiometrically close to SiO. After ~10 nm of the layer has been deposited the gas mixture is changed to move the stoichiometry of the layer 1621 closer to $SiO_2$.

Alternatively the properties may be changed by varying a dopant such as carbon added by bleeding in an appropriate gas (e.g. methane.) to the silane-oxygen mixture.

Either approach produces a layer of intermediate properties that facilitates the tunnelling of electrons from the substrate into the insulator.

EXAMPLE 5

Figure 2I:
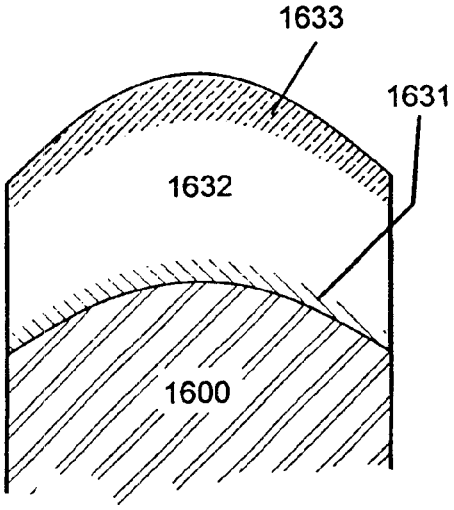

Moving now to FIG. 2*i*, layers 1631 and 1632 are the same composition as those in Example 5 (FIG. 2*i*). However, in this case the gas mixture is changed towards the end of the deposition process to increment the stoichiometry of the surface region 1633 away from $SiO_2$ towards, but not approaching, SiO. The thickness of layers 1631 and 1633 is of the order of 10 nm. This modifies the surface in a way that facilitates electron emission.

EXAMPLE 6

The metal surface onto which the insulator layer is created may be slightly oxidised prior to coating. Suitable metals are copper, iron, molybdenum, nickel, platinum, tantalum, titanium, tungsten. Suitable alloys are steels, nickel-iron, chromium-iron, nickel-chromium-iron, nickelcobalt-iron. The oxidation may be controlled by a careful choice of atmosphere e.g. wet hydrogen in the same manner as glass to metal sealing. The oxide formed may be an insulator or it may react with the insulator layer to form a layer of intermediate properties, graded from conductive adjacent the metal surface to insulating adjacent the insulator layer. Such a a layer of intermediate properties facilitates the tunnelling of electrons from the substrate into the insulator.

Let us now move on to the uses of these teachings in practical emitters. It should be understood that the following descriptions are only illustrative of certain embodiments of the invention. Various alternatives and modifications can devised by those skilled in the art.

Figure 3A:
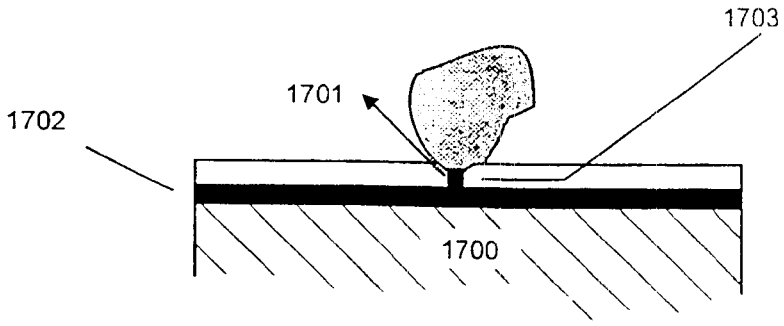
Figure 3B:
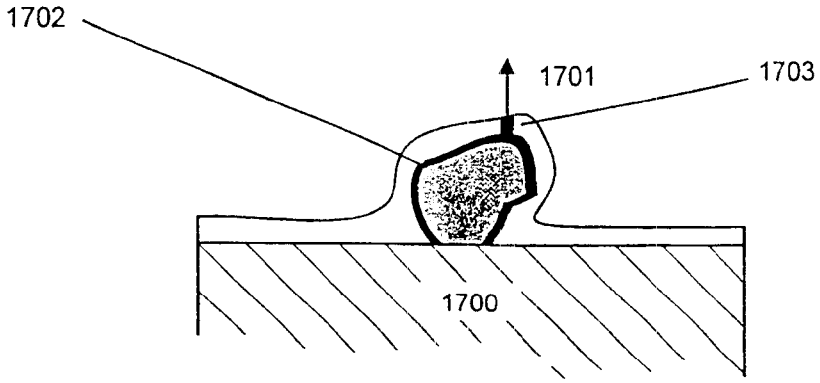
Figure 3C:
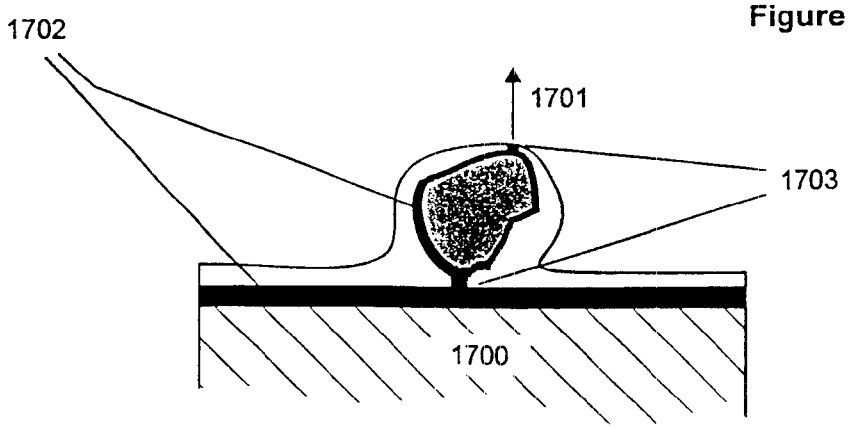
Figure 3D:
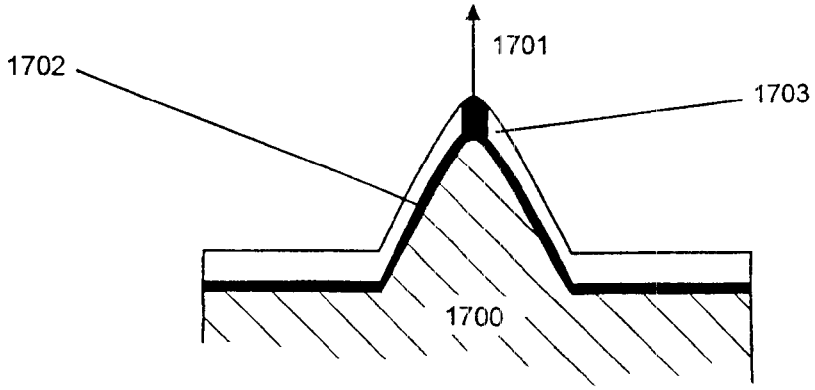

FIGS. 3*a* to 3*d* show some uses of optimised insulating coatings in emitter systems. In all cases the conducting substrate is labelled 1700 and the conducting channel and its associated electron emission 1701. The optimised interface layer between the substrate 1700 and the insulator 1703 is labelled 1702, and can be created in any of the ways previously described. FIGS. 3*a* and 3*b* show conducting particle based MIV emitters as previously described in our patent application GB 2 332 089. FIG. 3*c* is a MIMIV emitter as described by Tuck, Taylor and Latham (GB 2 304 989). FIG. 3*d* is a microfabricated tip emitter. The basic principles of the emission of electrons will be apparent from the foregoing description, and are therefore not repeated again here.

Figure 4A:
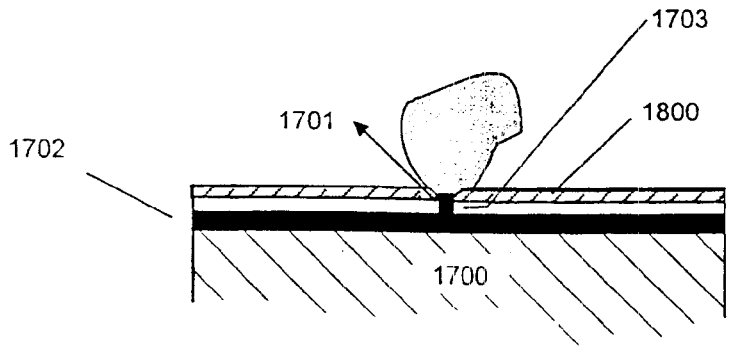
Figure 4B:
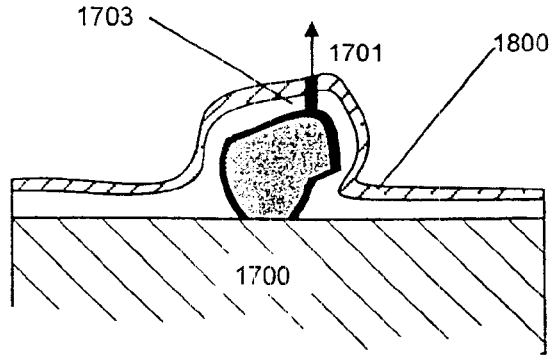
Figure 4C:
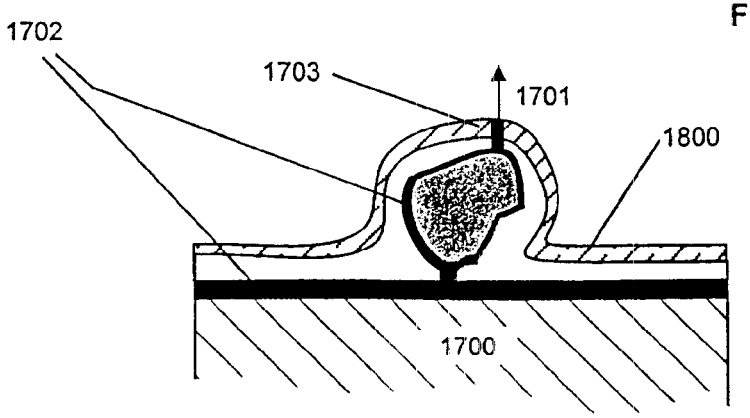
Figure 4D:
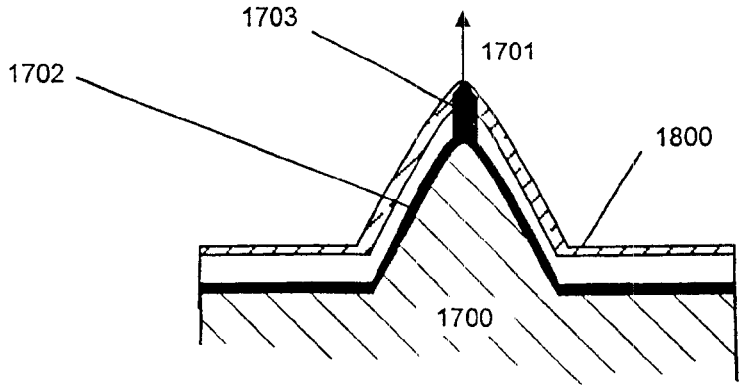

FIGS. 4*a* to 4*d* show how an optimised surface region 1800 of the insulator coating 1703 may be used in the same emitter systems as previously described and detailed in FIGS. 3*a* to 3*d*. FIG. 4*a* corresponds with FIG. 3*a* et cetera as do the reference numbers and descriptions. The optimised surface region 1800 can be created in any of the ways previously described. The basic principles of the emission of electrons will be apparent from the foregoing description, and are therefore not repeated again here.

Preferred embodiments of the invention provide emitting materials which are designed deliberately to have a significant density of emitting sites, as opposed to accidental and unwanted sparse inclusions of sporadic emitters, as have been noted from time to time in the vacuum insulating field, for example.

In preferred embodiments of the invention, the distribution of emitting sites over the field electron emission material is preferably random, with an average density of at least $10^2$ $cm^{-2}$, $10^3$ $cm^{-2}$, $10^4$ $cm^{-2}$ or $10^5$ $cm^{-2}$. The distribution is also substantially uniform and, preferably, when using a circular measurement area of 1 mm in diameter, is substantially Binomial or Poisson. The uniformity may be such that the density of the emitting sites in any circular area of 1 mm diameter does not vary by more than 20% from the average density of distribution of sites for all of the field electron emission material. The distribution of the emitting sites over the field electron emission material may have a uniformity such that there is at least a 50% probability of at least one emitting site being located in any circular area of 4 $\mu$m or 10 $\mu$m diameter.

In this specification, the verb "comprise" has its normal dictionary meaning, to denote non-exclusive inclusion. That is, use of the word "comprise" (or any of its derivatives) to include one feature or more, does not exclude the possibility of also including further features.

The reader's attention is directed to all papers and documents which are filed concurrently with or previous to this specification in connection with this application and which are open to public inspection with this specification, and the contents of all such papers and documents are incorporated herein by reference.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings), may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

What is claimed is:

1. A method of creating a field electron emission material, comprising the steps of:

providing a substrate having an electrically conductive surface;

providing a plurality of electron emission sites on said conductive surface, each of said sites including a respective layer of electrically insulating material to define a primary interface region between said conductive surface, or an electrically conductive particle on said conductive surface, and said insulating layer, and a secondary interface region between said insulating layer and the environment in which the field electron emission material is disposed; and treating or creating the primary interface region of each said layer so as to enhance the probability of electron injection from said conductive surface into said layer, such treatment or creation comprising:

depositing a layer of material between said conductive surface and insulating layer, which layer of material has properties intermediate those of said conductive surface and said insulating layer; or doping said conductive surface and/or insulating layer with a material that segregates out at said primary interface region during subsequent processing; or reaction of the materials of said conductive surface and insulating layer; or creating said primary interface region as a region of high electrically active doping, high defect density or intermediate chemical composition:

such that said primary interface region after said treatment or creation is either an insulator or graded from conducting adjacent said conductive surface to insulating adjacent said insulating layer.

2. A method according to claim 1, wherein said layer of material between said conductive surface and insulating layer is created by a gradual change in stoichiometry, composition or doping of the material of the layer, to reduce discontinuity.

3. A method according to claim 1, further comprising the step of selecting the properties of said insulating layer of each said site between the respective said primary and secondary interface regions to limit the emission current flowing through said layer to a predetermined value.

4. A method according to claim 1, wherein said substrate is of metal and said primary interface region is a layer of material of low work function.

5. A method according to claim 1, wherein said primary interface region is created as a region of high doping, high defect density or intermediate composition.

6. A method according to claim 5, wherein a region of high defect density is created by heat treating a major portion of a highly defective insulator material to create said insulating layer, whilst avoiding heat treatment of an end portion of said highly defective insulator material, which end portion then remains as said region of high defect density.

7. A method according to claim 1, wherein said secondary interface region is provided by modifying the surface of said insulating layer, to enhance the probability of electron transmission from said insulating layer to said environment.

8. A method according to claim 7, wherein modification of said surface is by a local increase in defect density of the material of the insulating layer.

9. A method according to claim 7, wherein modification of said surface is by a gradual change in stoichiometry, composition or doping to reduce discontinuity.

10. A method according to claim 1, wherein some or all of said electron emission sites are defined by tips or projections created on said electrically conductive surface of said substrate.

11. A method according to claim 1, wherein some or all of said electron emission sites are defined by electrically conductive particles coated on said electrically conductive surface of said substrate.

12. A method according to claim 1, wherein said secondary interface region is defined at a region of said insulating layer between an electrically conductive particle and said electrically conductive surface of said substrate.

13. A method according to claim 1, wherein said secondary interface region is defined at a region of said insulating layer which is provided on a portion of a respective said particle which faces away from said conductive surface.

14. A method according to claim 1, wherein each said particle has a first layer of electrically insulating material between said substrate and particle and a second layer of electrically insulating material between said particle and environment, the arrangement being such that, in use, electron emission takes place by injection of electrons through one said primary interface region defined between said substrate and said first insulating layer, by injection of electrons through another said primary interface region defined between said particle and said second insulating layer, and by transmission of electrons through said secondary interface region defined between said second insulating layer and said environment.

15. A method according to claim 14, wherein said first and second insulating layers are provided by respective portions of a common electrically insulating material.

16. A method according to claim 1, wherein said insulating layer is of a material other than diamond.

17. A method according to claim 1, wherein the distribution of said sites over the field electron emission material is random.

18. A method according to claim 1, wherein said sites are distributed over the field electron emission material at an average density of at least $10^2$ $cm^{-2}$.

19. A method according to claim 1, wherein said sites are distributed over the field electron emission material at an average density of at least $10^3$ $cm^{-2}$, $10^4$ $cm^{-2}$ or $10^5$ $cm^{-2}$.

20. A method according to claim 1, wherein the distribution of said sites over the field electron emission material is substantially uniform.

21. A method according to claim 20, wherein the distribution of said sites over the field electron emission material has a uniformity such that the density of said sites in any circular area of 1 mm diameter does not vary by more than 20% from the average density of distribution of sites for all of the field electron emission material.

22. A method according to claim 20, wherein the distribution of said sites over the field electron emission material when using a circular measurement area of 1 mm in diameter is substantially Binomial or Poisson.

23. A method according to claim 20, wherein the distribution of said sites over the field electron emission material has a uniformity such that there is at least a 50% probability of at least one emitting site being located in any circular area of 4 $\mu$m diameter.

24. A method according to claim 20, wherein the distribution of said sites over the field electron emission material has a uniformity such that there is at least a 50% probability of at least one emitting site being located in any circular area of 10 $\mu$m diameter.

25. A field electron emission device comprising a field electron emission material produced by a method according to claim 1, and means for subjecting said material to an electric field in order to cause said material to emit electrons.

* * * * *